United States Patent [19]

Schibbye et al.

[11] 4,443,170

[45] Apr. 17, 1984

[54] ARRANGEMENT AT OIL-INJECTED HIGH-PRESSURE SCREW COMPRESSOR

[75] Inventors: Lars L. B. Schibbye, Älgvägen; Rolf A. Englund, Sandkullsvägen, both of Sweden

[73] Assignee: Sullair Technology AB, Stockholm, Sweden

[21] Appl. No.: 444,240

[22] Filed: Nov. 24, 1982

[30] Foreign Application Priority Data

Nov. 25, 1981 [SE] Sweden ..... 8107014

[51] Int. Cl.[3] ..... F01C 1/16; F03C 2/00; F04C 29/02

[52] U.S. Cl. ..... 418/203; 418/98; 308/215

[58] Field of Search ..... 418/201–203, 418/98; 308/215; 384/99

[56] References Cited

U.S. PATENT DOCUMENTS 2,578,196 12/1951 Montelius ..... 418/203
3,241,744 3/1966 Schibbye ..... 418/201
3,462,072 8/1969 Schibbye ..... 418/98
3,947,078 3/1976 Olsaker ..... 418/203

*Primary Examiner*—Leonard E. Smith
*Assistant Examiner*—Jane E. Obee
*Attorney, Agent, or Firm*—Wood, Dalton, Phillips, Mason & Rowe

[57] ABSTRACT

The invention relates to an arrangement at oil-injected screw compressors for high pressures. The arrangement is characterized in that the length/diameter ratio of the rotors is lower than 1,3:1, that taper roller bearings in pairs (19–21) are used at both shaft ends (15–18) of the rotors, that the bearings (19,21) at the high-pressure end (13) of the rotors are arranged so that the wider edges of the inner rings of the bearings are facing toward each other and are capable to take up both radial and axial forces, that the bearings (20,22) at the low-pressure end (14) of the rotors are arranged so that the narrower edges of the inner rings of the bearings are facing toward each other and are capable to take up only radial forces, and that oil-pressure actuated balancing pistons (23,24) are provided at the shaft ends (16,18) on the low-pressure end of the rotors to take up the major part of the axial forces initiated by the compressor.

7 Claims, 1 Drawing Figure

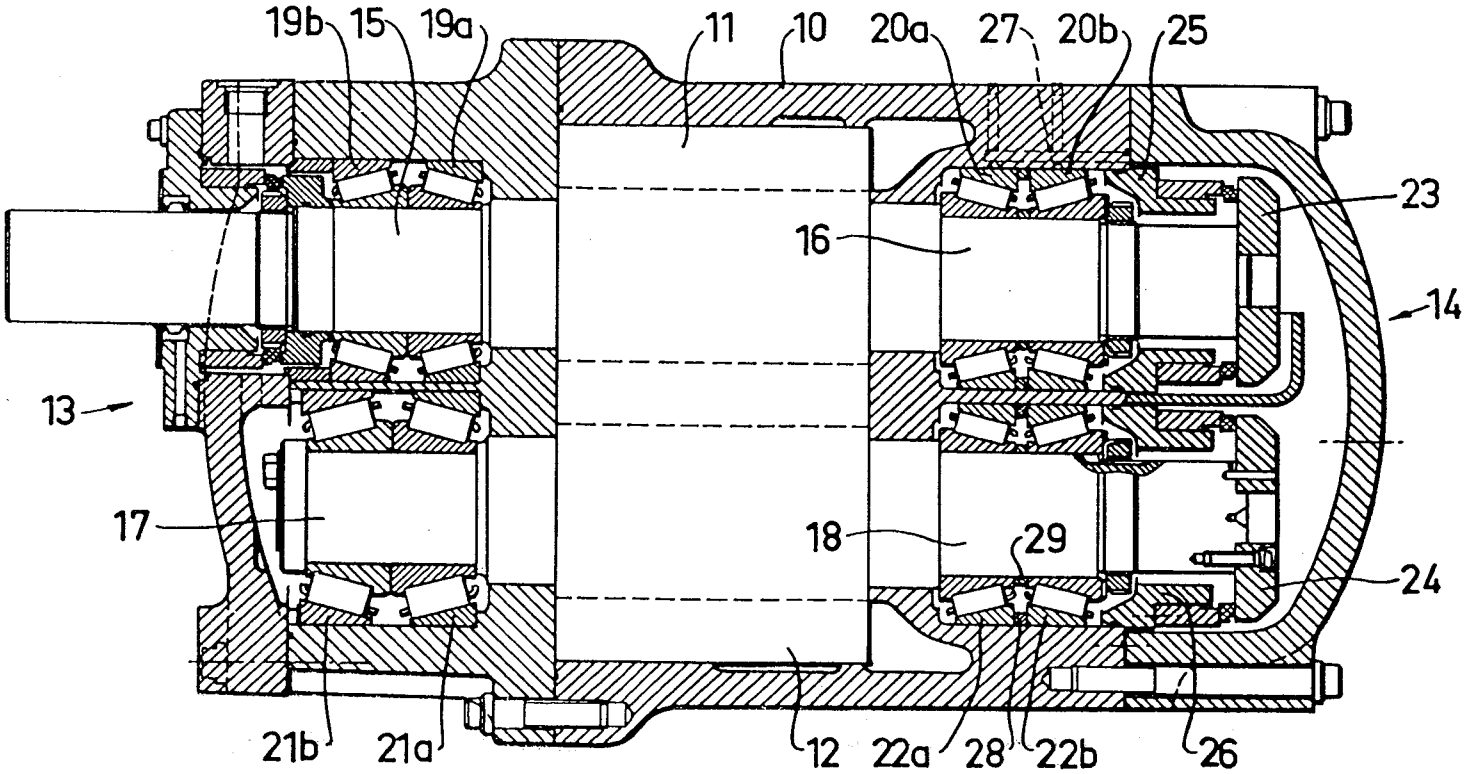
14
23
24
25
26
20b
22b
27
29
28
20a
22a
10
16
18
12
11
19a
21a
15
19b
21b
17
13

ARRANGEMENT AT OIL-INJECTED HIGH-PRESSURE SCREW COMPRESSOR

This invention relates to an arrangement at oil-injected screw compressors for high pressures, especially to an arrangement for the bearing of both rotors of the compressor.

Oil-injected screw compressors normally operate with an outlet pressure of the magnitude 7–20 kg/cm$^2$. The rotors in these compressors usually are supported in conventional ball and roller bearing arrangements, which at the pressures stated does not involve any problems in respect of the desired length of the service life of the bearings. At screw compressors with outlet pressures exceeding those stated above, the only alternative heretofore has been to use an entirely different bearing type, viz. slide bearings, for taking up the substantially increasing radial forces of such compressors. This bearing type, however, shows several disadvantages, which are due to the sensitivity to necessarily supplied bearing oil pressure, especially at starting, at which the arrangement must be additionally provided with an oil pump. Said disadvantages also are due to increasing friction losses.

The present invention has the object, therefore, to produce an arrangement for high-pressure screw compressors, by which arrangement the aforesaid sliding bearing arrangements can be avoided.

At conventional oil-injected screw compressors for relatively low pressures, the rotors normally are dimensioned for a length/diameter relation of the magnitude 1.5:1 or higher. On the high-pressure side of the compressor normally are arranged bearings of ball or roller type in pairs in order to take up not only the radial forces on that side of the compressor, but also for taking up the total axial forces affecting the rotors. On the low-pressure side of the compressor usually cylindrical roller bearings are used for taking up the radial forces on this side. This conventional arrangement, however, cannot be applied to high-pressure compressors, above all due to the fact that it is not possible to achieve a service life of sufficient length for the bearings, especially for the bearing arrangement taking up axial and radial forces on the high-pressure side of the compressor.

The aforesaid object has been achieved in that the invention has been given the characterizing features defined in the attached claims.

We have found by theoretical calculations and tests, that by dimensioning the rotors with a substantially lower length/diameter ratio than the normal one a great part of the radial forces can be transferred from the high-pressure side to the low-pressure side, owing to the effect of the eccentric action position of the axial forces on the rotors. The combined axial and radial force on the bearings on the high-pressure side could hereby be reduced so that acceptable service life lengths for these bearings could be achieved. Owing to this change in the distribution of the radial forces, however, the conventional cylindrical radial bearing type could not longer be used on the low-pressure side. For this reason, an entirely new radial bearing arrangement has been developed for this purpose.

The invention is described in greater detail in the following, by way of an embodiment illustrated in the accompanying drawing, in which the FIGURE is a section through the screw compressor with an arrangement according to the invention.

In the FIGURE, thus, a rotor housing 10 is shown, in which two rotors, a male rotor 11 and a female rotor 12, are in engagement with each other. The compressor includes a high-pressure side 13 and a low-pressure side 14. The male rotor 11 has at the high-pressure side a projecting shaft end 15 and at the low-pressure side a projecting shaft end 16. The female rotor 12 has at the high-pressure end a projecting shaft end 17 and at the low-pressure end a projecting shaft end 18. All of the shaft ends 15–18 are supported in the rotor housing 10 by taper roller bearings **19*a*,19*b*,20*a*,20*b*,21*a*,21*b*,-22*a*,22*b* arranged in pairs on the rotor shaft ends. The roller bearing pairs on the high-pressure side 19*a*,19*b*,-21*a*,21*b* are so arranged on the shaft ends 15 and, respectively, 17 that the wider edges of the inner rings of the bearings face toward each other. On the low-pressure side, however, the pairs of taper roller bearings 20*a*,20*b*,22*a*,22*b* are arranged so on the shaft ends 16 and, respectively, 18 that the narrower edges of the inner rings of the bearings face toward each other, and so that the rollers are inclined to each other inward to the center of the shaft. The bearings 20*a*, 20*b* and, respectively, 22*a*,22*b* on the low-pressure side are mounted with an internal axial clearance, preferably of the magnitude 0.03–0.05 mm. This internal clearance adjustment is brought about by adjusting the thickness of the rings 28 and 29. The outer rings of these bearings are mounted free in axial direction, so that these outer rings can move freely in axial direction. Hereby these bearings are prevented from taking up any axial forces. In order to balance the main part of the axial forces acting on the rotors, a balancing piston 23 and, respectively, 24 are located at each shaft end 16,18 on the low-pressure side. To these balancing pistons oil under pressure can be supplied in order to bring about the desired balancing force. The outer diameters of the balancing pistons preferably are sealed by mechanical sealings 25 and 26**.

Owing to the afore-described arrangement of the two co-operating bearings **20*a* and 20*b* and, respectively, 22*a* and 22*b* the achievement has been made that the total radial force is distributed substantially uniformly between these co-operating bearings, and that the length/diameter ratio has been limited to values much lower than the normal ones. Owing to said arrangement, the service life length could be increased to acceptable values, contrary to what has been the case at conventional and heretofore known screw compressor arrangements. A further essential advantage with the aforesaid bearing arrangement is, that possible heat expansions of the shaft ends 16,18 on the low-pressure side do not give rise to any axial force on the bearings 20*a*,20*b* and, respectively, 22*a*,22*b* on the low-pressure side. When an extension of the shaft end in relation to the rotor housing should occur, the greatest part of the radial forces is transferred, thanks to the internal clearance between the bearings 20*a* and 20*b* and, respectively, 22*a* and 22*b*, to the bearing located closest to the compression space, i.e. to the bearings 20*a* and 22*a*, whereby the outer ring of these bearings 20*a* or 22*a***, in addition to the temporary axial force caused by the extension, also is affected by the temporary axial component resulting from said radial force on this bearing. The total axial force on the outer ring, which force, thus, temporarily consists of two parts acting in the same direction, hereby assumes a substantial size, which is sufficient for effecting the friction forces between the outer rings of the bearings and the rotor housing to be overcome, whereby an axial movement of these outer rings is obtained. Hereby an adaptation to the aforesaid extension of the shaft end is obtained in such a manner, that the bearings again are axially relieved and, thus, take up only radial forces, and so that the distribution of these forces will be substantially uniform.

In order to facilitate the friction forces between the outer rings of the bearings and the rotor housing to be overcome, grooves 27 for the supply of oil under pressure are provided adjacent the outer rings of the bearings. Said grooves 27 preferably can be arranged substantially in the direction of action of the greatest radial forces.

What we claim is:

1. An arrangement at oil-injected screw compressors for high pressures, characterized in that the length-/diameter ratio of the rotors is lower than 1.3:1 in claim 1, that taper roller bearings in pairs are used at both shaft ends of the rotors, that the bearings at the high-pressure end of the rotors are arranged so that the wider edges of the inner rings of the bearings are facing toward each other and are capable to take up both radial and axial forces, that the bearings at the low-pressure end of the rotors are arranged so that the narrower edges of the inner rings of the bearings are facing toward each other and are capable to take up only radial forces, and that oil-pressure actuated balancing pistons are provided at the shaft ends on the low-pressure end of the rotors for taking up the major part of the axial forces initiated by the compressor.

2. An arrangement as defined in claim 1, characterized in that the outer rings of the bearings at the high-pressure end of the rotors are axially fixed, while the outer rings of the bearings at the low-pressure end of the rotors are axially free.

3. An arrangement as defined in claim 1, characterized in that the bearings at the low-pressure end of the rotors are provided with an internal axial clearance, preferably of the magnitude 0.03 to 0.05 mm.

4. An arrangement as defined in claim 1, characterized in that at the bearings at the low-pressure end of the rotors grooves are provided in the bearing housing adjacent the outer rings of the bearings for supplying oil under pressure.

5. An arrangement as defined in claim 4, characterized in that the grooves are arranged substantially in the direction of action of the radial forces.

6. An arrangement as defined in claim 1, characterized in that all bearings in the compressor have the same dimension.

7. An arrangement as defined in claim 1, characterized in that the outer diameter of the balancing pistons are sealed by mechanical sealings, so that the oil pressures supplied safely can be maintained.

* * * * *